US008221208B2

(12) United States Patent
Hill et al.

(10) Patent No.: US 8,221,208 B2
(45) Date of Patent: Jul. 17, 2012

(54) ONLINE TERMINAL BASED LOTTERY GAME WITH A SLOT MACHINE THEME

(75) Inventors: Amy Hill, Cumming, GA (US); Svetlana Ekisheva, Atlanta, GA (US); Charles Boykin, Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 664 days.

(21) Appl. No.: 12/356,591

(22) Filed: Jan. 21, 2009

(65) Prior Publication Data

US 2009/0191938 A1 Jul. 30, 2009

Related U.S. Application Data

(60) Provisional application No. 61/024,308, filed on Jan. 29, 2008.

(51) Int. Cl.
*A63F 9/24* (2006.01)

(52) U.S. Cl. ..... 463/16; 463/20; 463/22; 463/11; 463/13

(58) Field of Classification Search ..... 463/16, 463/17, 19, 20, 21, 22, 11, 13; 273/274, 273/148 R
See application file for complete search history.

(56) References Cited

U.S. PATENT DOCUMENTS

| | | | | |
|---|---|---|---|---|
| 5,100,139 | A | 3/1992 | Di Bella | |
| 6,224,055 | B1 | 5/2001 | Walker et al. | |
| 7,134,959 | B2 | 11/2006 | Penrice | |
| 7,749,061 | B2 * | 7/2010 | Walker et al. | 463/13 |
| 2002/0074725 | A1 * | 6/2002 | Stern | 273/274 |
| 2005/0059464 | A1 | 3/2005 | Bozeman | |
| 2007/0129134 | A1 * | 6/2007 | Barrie | 463/20 |
| 2008/0132314 | A1 * | 6/2008 | Robb et al. | 463/17 |

FOREIGN PATENT DOCUMENTS

| | | |
|---|---|---|
| EP | 0 398 767 A2 | 11/1990 |
| WO | WO 97/27570 | 7/1997 |
| WO | WO 2005/039711 A2 | 5/2005 |

OTHER PUBLICATIONS

PCT Search Report, May 8, 2009.

* cited by examiner

*Primary Examiner* — Julio J Maldonado
(74) *Attorney, Agent, or Firm* — Dority & Manning, P.A.

(57) ABSTRACT

A method and system for playing a terminal based lottery game having a slot machine theme includes assigning a defined set of objects to respective slot positions, the objects being unknown to game players. A player chooses at least one grouping of the slot positions from a plurality of possible groupings, and the system records the player's selection. For each of the slot positions, the system randomly selects an object from the set of objects assigned to each respective slot position such that a play set of the objects is generated for the player's grouping of slot positions. The player is awarded a prize amount that is a function of the number or combination of matches of objects within the player's play set. The methodology and system are particularly well suited for a poker slot machine theme game wherein the player's selected grouping corresponds to a poker hand, with the objects assigned to the respective slot positions corresponding to a poker deck of cards.

26 Claims, 8 Drawing Sheets

ONLINE TERMINAL BASED LOTTERY GAME WITH A SLOT MACHINE THEME

PRIORITY CLAIM

The present application claims priority to U.S. Provisional Application Ser. No. 61/024,308, filed Jan. 29, 2008.

FIELD OF THE INVENTION

The present invention relates to an online terminal based lottery game, and more particularly to a system and method for conducting a terminal based lottery game that emulates a slot machine.

BACKGROUND OF THE INVENTION

Online or "terminal based" lottery games are well known in the art. Such games typically have a game theme, such as "Pick-3", Pick-4", "Lotto", "Powerball", and so forth. These games are conducted at multiple gaming terminals located at various commercial establishments, with the terminals in communication with a central gaming authority computer system. Players purchase a lottery ticket at the point of sale terminals. Generally, the games are premised on the basic concept of a player placing a wager and selecting one or more objects (i.e., numbers, letters, symbols, and the like) from a defined field of such objects, for example by completing a play slip, or opting for a randomly generated selection by the terminal. At a later established time, the gaming authority conducts the lottery draw wherein a set of the objects is randomly generated and published. Players win if their selection matches one or some combination of the randomly generated objects.

Online lottery games are attractive to gaming authorities in that the games can be conducted over a broad geographic region to a large number of players for a single play event. The games can be closely monitored and controlled by the host system and networked game terminals. The prize awards to players are typically larger for online games as compared to instant play games (i.e., instant scratch-off lottery tickets), which is attractive to potential players.

It is generally recognized in the industry that new and different games are essential to sustaining the public's interest and participation in lottery games. Game themes grow stale over time, and must be replaced with newer, more exciting games. In this regard, the instant play lottery games have an advantage over online games in that they are amenable to a wider range of game concepts and themes. New and widely varying themes for instant lottery game tickets are continuously offered. Development and successful implementation of new online lottery games is, however, significantly more difficult.

The present invention is useful in that it provides a method and system for conducting an online lottery game that retains the benefits of online gaming yet offers the attraction to players of instant play lottery games.

SUMMARY OF THE INVENTION

Objects and advantages of the invention will be set forth in part in the following description, or may be obvious from the description, or may be learned through practice of the invention.

In one embodiment, the present invention provides a method for playing a terminal based lottery game having a slot machine theme. The game emulates the aspects players find desirable in slot machines and instant lottery games, yet provides the game as an online terminal based game that is offered to a great number of players over a wide terminal network. Aspects of the methodology include assigning a defined set of objects to respective game slot positions. The set of objects simulate a "reel" in a slot machine, with the reel containing a defined arrangement and order of objects. The objects may be, for example, any indicia, symbols, graphics, or the like, commonly used in slot machine game themes. Winning may be based on any combination or number of object matches, as is commonly understood. It should be appreciated that the present methodology is not limited by any particular game theme or game objects.

The game objects are assigned to the respective slot positions in the game by the gaming authority and are unknown to game players. Upon placing a wager to play the game, a player is requested to choose at least one grouping of the slot positions from a plurality of possible groupings established by the gaming authority. This grouping simulates a group of objects displayed in a slot machine game. For example, the player may select a single grouping of horizontal slot positions having, for example, five slots. In another embodiment, the player may be presented with multiple horizontal rows of slot positions, and may wager on any one or all of the horizontal groupings. Additional groupings may include a combination of slot positions from different horizontal rows. For example, a "V" or "Λ" grouping may include slot positions from three different horizontal groupings. The amount of the player's wager is a function of the number of groupings selected for play.

The player may select their grouping by any conventional terminal based input method. For example, the player may mark their selection on a play slip that is scanned and read at the terminal. In an alternate embodiment, the selection can be manually inputted by a clerk or the player via a keypad or touch screen.

After recording the player's wager and selection of slot position groupings, the game is continued by the system simulating a play of a slot machine. The terminal (alone or in configuration with a central gaming authority computer) randomly selects an object from the reel or set of objects assigned to each respective slot position such that a play set of the objects is generated for the player's grouping of slot positions. The results of this play are indicated on a lottery ticket that is subsequently provided to the player. The ticket indicates the player's selected grouping(s) of slot positions and the randomly generated objects associated with each slot position. As with conventional slot machine games, the player is awarded a prize amount that is a function of the number or combination of matches of objects within the player's play set.

As mentioned, multiple possible groupings may be presented to the player for play, with the player's wager being a function of the number of groupings selected. The player would be eligible for a prize for each selected group. The system may generate a play set for all of the possible groupings and present all of the play sets to the player (including the groupings not purchased by the player). In this way, the player is aware of the value of the prize for any grouping not selected for play by the player. This may encourage the player to purchase additional groupings in the next play, particularly if prizes would have been won for the non-selected groupings.

The lottery game may be played at a plurality of terminals that are in communication with a central game authority controller (i.e., computer system), wherein the set (i.e., reel) of objects assigned to respective slot positions is the same for all of the terminals and does not change between games. In an alternate configuration, the set of objects assigned to respective slot positions varies between different game terminals. In other words, the "reels" are different for the various slot machines (terminals). For any individual terminal, the set and order of objects assigned to respective slot positions may not change for each respective terminal. In another embodiment, the set or order of objects assigned to each respective slot position may change between games.

In a particularly unique embodiment of the gaming method, the lottery game has a poker slot machine theme, and includes assigning a set (i.e., reel) of poker playing cards to the respective slot positions such that an entire deck of 52 poker playing cards is accounted for by the sets. The cards assigned to the respective slot positions are unknown to game players. Players are requested to choose at least one poker hand (grouping) of slot positions from a plurality of possible hands, as discussed above. The player's selection and wager are inputted and recorded at the game terminal. For each of the slot positions, the system randomly selects a card from the set of poker playing cards assigned to the respective slot position such that a poker hand is generated for the player's hand of slot positions. The player is awarded a prize amount that is a function of the player's poker hand such that a stronger poker hand wins a greater prize amount. For example, a full house wins a greater prize than two pairs.

As discussed above, the player may have the option to wager on up to all of a plurality of possible poker hands, and is awarded a prize amount for each winning poker hand wagered on. The system may generate a random poker hand for all of the possible hands initially presented to the player for selection, and reveal all of the hands to the player on the lottery ticket so that the player is aware of the value of any poker hand they did not select for play.

The lottery game may include an optional color match play wherein the player pays an additional wager and wins a designated prize value if all of the objects in one of their selected groupings have the same color (or some other color requirement, such as all different colors). This option lends itself well to the poker theme in that a hand of cards may all be the same color without being a flush. For example, the player's hand may contain two spades and three clubs, and thus qualify as a winning "color match" hand. Of course, if the hand is also a flush, the player wins the prize value for a flush in addition to the color match prize value.

The lottery game may be played at a plurality of terminals in communication with a central game controller, wherein the set of poker playing cards assigned to respective slot positions is the same for all of the terminals and does not change between games. In an alternate embodiment, the set of poker playing cards assigned to respective slot positions varies between different game terminals. At any individual terminal, the set of poker playing cards assigned to respective slot positions may not change for each respective terminal.

The present invention also encompasses a system configuration for playing the online slot machine theme game that includes a central computer system having a hardware and software configuration to conduct the lottery game for multiple players via remote gaming terminals in communication with the central computer. Each of the terminals further includes an input device configured to receive a player's selection of at least one grouping of simulated slot positions. This device may be a play slip scanner, touch screen, keypad, or the like. A value input device is configured to receive the player's wager for playing one or more groupings of the slot positions.

A terminal controller with a processor and memory operatively coupled to the processor operates with the input device, the value input device, and the central computer to receive and record the player's selected grouping of slot positions from a plurality of possible groupings; assign a defined set of objects to respective slot positions, the objects assigned to the respective slot positions being unknown to game players; for each of the slot positions, randomly select an object from the set of objects assigned to the respective slot position such that a play set of the objects is generated for the player's selected grouping of slot positions and provided to the player via a lottery ticket; and compute a prize amount that is a function of the number or combination of matches of objects within the player's selected grouping.

The terminal controller (alone or operating with the central computer) can generate a play set of objects for all of the possible groupings and present the play sets to the player via the lottery ticket printed at the terminal so that the player is aware of the prize value for any grouping not selected for play by the player. The terminal controller is configured to accept wagers from the player for up to all of the possible groupings, and to compute a prize amount for each winning grouping.

In one embodiment, the central game controller defines the set of objects assigned to respective slot positions the same for all of the terminals and does not change the defined sets of objects between games. In an alternate embodiment, the central game controller defines the set of objects assigned to respective slot positions differently for different game terminals.

Aspects of the inventive method and system are discussed below by reference to particular embodiments illustrated in the figures.

DETAILED DESCRIPTION

Reference will now be made to embodiments of the invention, particular examples of which are illustrated in the figures. Each embodiment is provided by way of explanation of the invention, and not meant as a limitation of the invention. For example, features or described with respect to one embodiment, can be used with another embodiment, to yield still a further embodiment. It is intended that the invention encompass these and other modifications as come within the scope and spirit of the appended claims.

Figure 1:
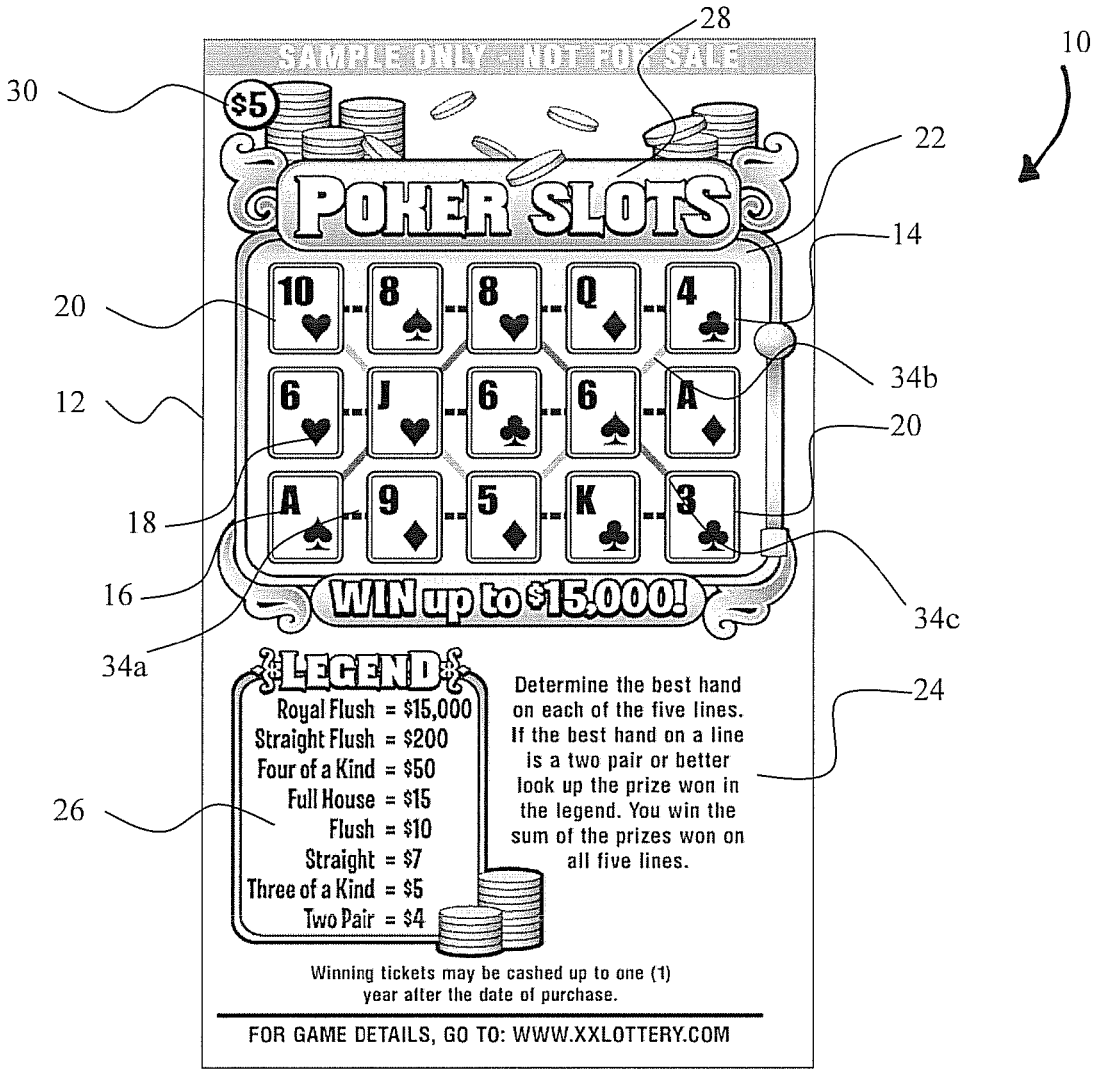
FIG. 1 is a perspective view of a lottery ticket incorporating aspects of a slot machine theme lottery game in accordance with a particular embodiment of the invention.

FIG. 1 is an illustration of a lottery ticket 12 for a particular embodiment of a lottery game 10 having a slot machine theme. In this particular embodiment, the ticket 12 incorporates a poker slot machine theme. The ticket 12 illustrated in FIG. 1 corresponds to the ticket that would be printed at an online terminal and provided to the player after the player has made their poker hand selection and rendered a wager. The particular game referenced in the ticket 12 is a $5.00 wager game and entitles the player to play five different poker hands represented by various groupings 20 of slot positions 14. Three of the hands are represented by the horizontal groupings connected by the dashed lines 34*a*. Another grouping is a "V" grouping represented by the connecting lines 34*b*. The fifth poker hand is an inverted "Λ" represented by the connecting lines 34*c*.

The ticket 12 includes any manner of wager indicia 30 indicating the wager amount required for a player to play one or more of the poker hands.

The ticket 12 also includes any manner of game indicia 28 that advertises, displays, or graphically depicts the game theme.

The ticket 12 includes a rules area 24 that explains certain aspects of the game to the player, as well as a prize legend area 26 that sets forth the prize amounts for various poker hands. It should be appreciated that the various legends, indicia, and areas of the lottery ticket 12 may take on any configuration, visual appearance, format, and the like.

The ticket 12 includes a player area 22 that includes a plurality of groupings 20 of the individual slot positions 14. The slots positions 14 are preferably graphically illustrated as conventional slot machine windows, panes, or the like. Each slot position 14 includes an object 18 that was randomly generated by the lottery system from a set of the objects that is assigned to each slot position 14. This set of objects 18 emulates a "reel" of a conventional slot machine wherein a defined set and order arrangement of objects are provided for each slot position. In the poker slots machine game illustrated in FIG. 1, the objects 18 are playing cards 16. A complete deck of 52 poker playing cards (without duplicate cards) is accounted for by the cumulative sets of cards assigned to the slot positions. For example, the first two slot positions may include eleven cards each, while the last three slot positions may include sets of ten cards.

The game objects 18 (i.e. poker cards 16) are unknown to game players and, as explained in greater detail below, a player is requested to choose at least one of the groupings 20 of slot positions 14 as their poker hand. For example, the player may select one or more of the horizontal rows of slot positions, the "V" or "Λ" poker hands, or a combination of all of the hands. In the game represented in the ticket 12 of FIG. 1, the player paid a $5.00 wager for all of the represented poker hands. In different embodiments, the player may opt to play fewer hands for a lesser wager amount.

After the player's wager and selection of slot position groupings is recognized and recorded by the lottery terminal, the terminal (alone or in configuration with a central gaming authority computer) randomly selects an object 18 (i.e. playing card 16) from the set of objects assigned to the various respective slot positions 14 such that a play set of the objects 18 or cards 16 is generated for the player's selected grouping 20 of slot positions. The results of this random generation are indicated on the lottery ticket 12 that is subsequently provided to the player. The ticket 12 indicates the player's particular selected groupings 20 and the randomly generated objects 18 that correspond to each of the slot positions 14 within the groupings 20.

The player is awarded a prize amount that is a function of the number or combination of matches of objects 18 within the player's play set. In the game represented by the ticket in FIG. 1, the prize amount is a function of a winning poker hand, with a stronger poker hand winning a greater prize amount. For example, a straight flush in the game illustrated in FIG. 1 wins a prize amount of $200.00, while two pairs wins a prize amount of $4.00.

Figure 2A:
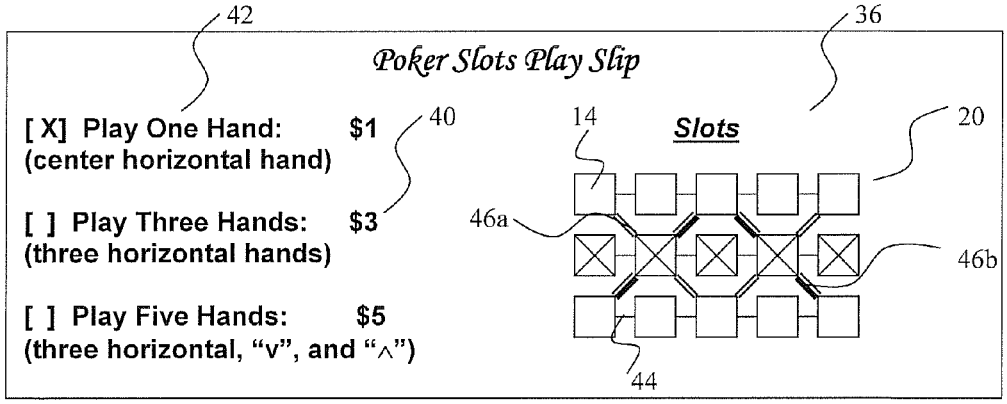
FIGS. 2A and 2B are a perspective view of a play slip and associated lottery ticket for an embodiment in accordance with the invention.

The player may enter their wager amount and selection of groupings by any conventional means. For example, the player's selection may be entered via touch screen or keypad associated with a lottery terminal. In alternative embodiments, the player may complete a play slip that is subsequently scanned and read by the lottery terminal. In the embodiment of FIG. 2A, a representative play slip 36 is provided for the game illustrated in the ticket 12 of FIG. 2B. In this particular game, the slot machine theme is a poker slots theme. The play slip 36 includes selection indicia 42 by which the player indicates how many hands they wish to play, as well as wager instructions or indicia 40 that clearly defines the wager amount for the respective hands. For example, in the embodiment of FIG. 2A, the player has selected to play one hand (center horizontal hand). This play requires a wager amount of $1.00. The player had the option to play all three horizontal hands for $3.00, or to play all five hands (the three horizontal hands, the "V" and "Λ" hands) for $5.00. The play slip 36 may include an area that also represents the possible groupings of individual slot positions 14 corresponding to the various possible poker hands. In the illustrated embodiment, the three horizontal hands are illustrated as slot positions 14 connected by horizontal connecting lines 44. The "V" hand is represented by the connecting lines 46*a*, and the "Λ" hand is represented by the connecting lines 46*b*. Desirably, some means of visually differentiating between the poker hands is provided. In the illustrated embodiment, the visual distinguishing means is represented merely by the different types or configuration of connecting lines 44, 46*a*, and 46*b*. It should be appreciated, however, that any other configuration of visually distinguishing means may be utilized in this manner. As an option, the player may also mark in the slot positions 14 corresponding to his selected play hand. For example, the player has placed an X in the center horizontal hand.

Figure 2B:
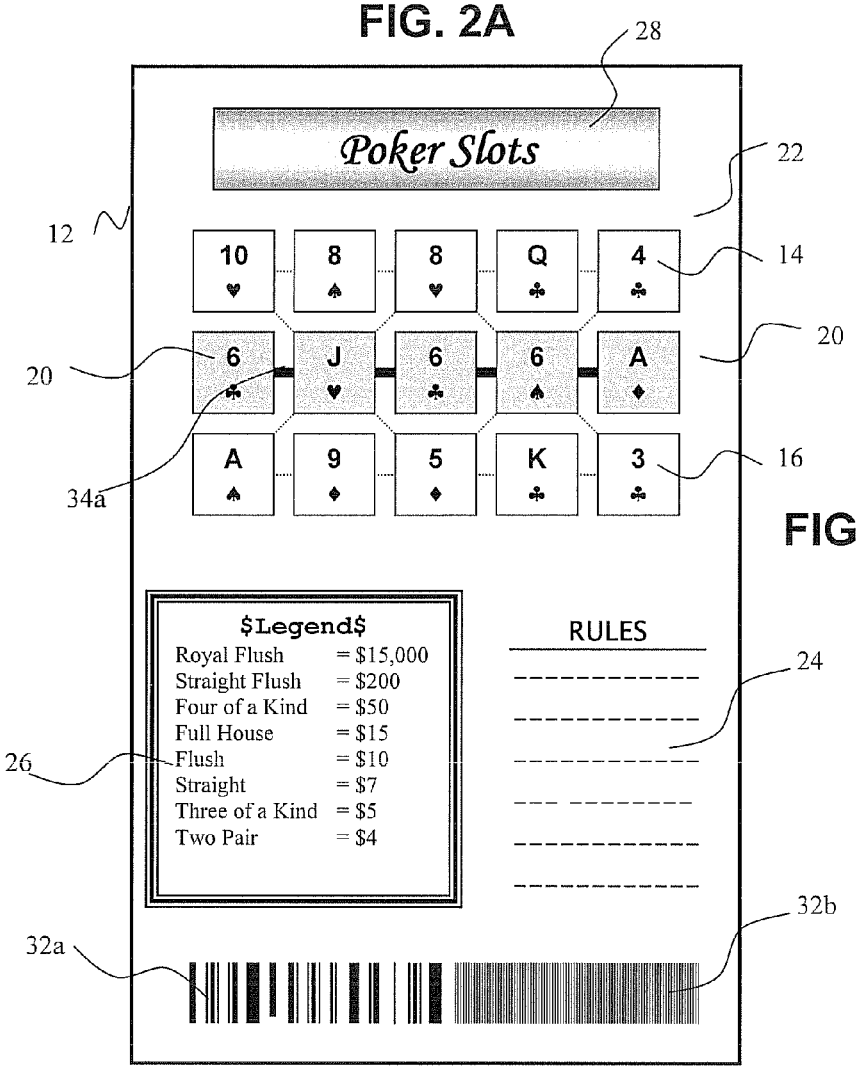

Play slip 36 is read and scanned by a lottery terminal machine, and a representative play ticket 12 illustrated in FIG. 2B is printed and provided to the player. The ticket 12 reflects the various possible groupings 20 of poker hands, and visually distinguishes the player's selected hand. For example, the player selected the center horizontal hand for play, and this hand is shaded in the lottery ticket 12 of FIG. 2B. In addition, the connecting line 34*a* is a solid and more distinguishing line as compared to the dashed lines connecting the other slot positions 14. Any other means of distinguishing the player's selected grouping 20 is within the scope and spirit of the invention. In this particular embodiment, the player's selected hand contains three of a kind. Thus, the player wins the $5.00 prize amount indicated in the prize legend 26.

Although not necessary, it may be desired to also present to the player the randomly generated objects 18 (e.g. cards 16) generated for the remaining slot positions 14. In this manner, the player is aware of the value of the prize for any of the groupings 20 or poker hands not selected for play by the player. In the particular game illustrated in FIG. 2B, no other winning hands were generated in the various combinations of hands, and thus the player selected the only winning hand.

To collect the prize award, the player submits the lottery ticket 12 to a clerk or other representative at the business establishment maintaining the lottery terminal, or any other designated lottery facility. The ticket 12 desirably includes any manner of bar code 32*a* or other coded security marking 32*b* that serves to validate the ticket 12. When the ticket 12 is generated, the bar code 32*a* or security mark 32*b* encodes the results of the game and indicates whether the ticket is a winning ticket, and the prize amount for any of the hands played by the player. This feature also relieves unsophisticated players not having a working knowledge of poker of the burden of determining whether or not they have won the game. The security codes also discourage tampering with the ticket 12 to present a false winning hand.

Figure 3A:
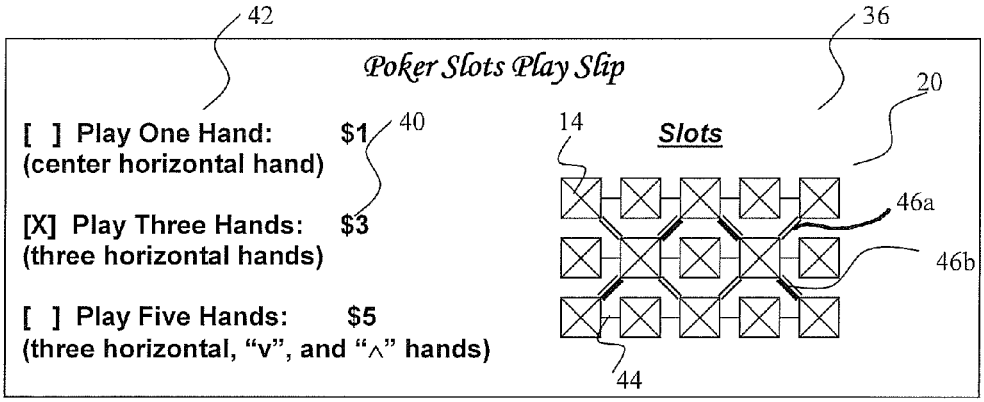
FIGS. 3A and 3B are perspective views of a play slip and lottery ticket for still an alternative embodiment.
Figure 3B:
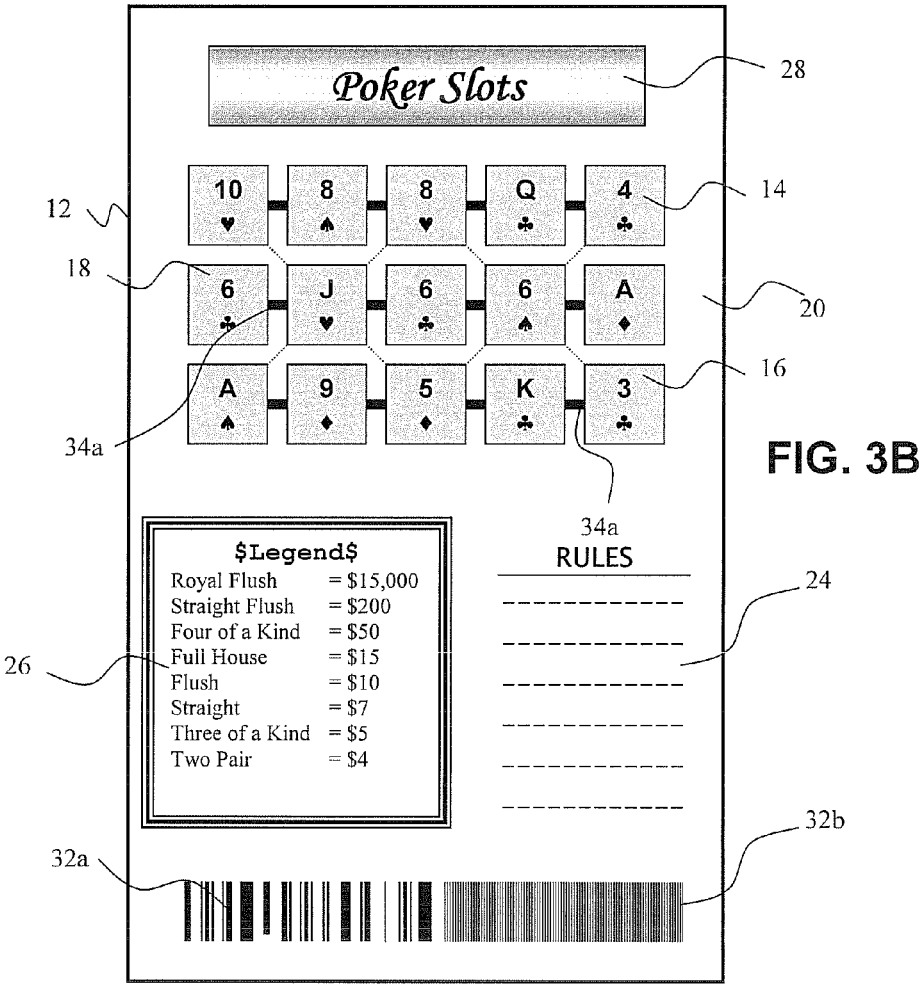

FIGS. 3A and 3B indicate a similar poker slots machine game. In this embodiment, the player selected to play the three horizontal hands via the play slip 36 and placed an X in all of the slot positions 14 on the play slip. The slot position representation does not necessarily distinguish between selection of only three horizontal hands, or all five hands, but the player selection of only three hands is clearly indicated in the selection area 42 of the play slip 36. Referring to the lottery ticket in FIG. 3B, all of the slot positions 14 are highlighted. However, the player selection of three horizontal hands is clearly indicated by the dark and more distinguishing connecting lines 34*a*. The ticket 12 in FIG. 3B clearly visually indicates that the player has played only the three horizontal hands. In this particular game, the middle horizontal hand contains three of a kind, and the player has won the prize of $5.00 for this hand, as indicated in the legend area 26.

Figure 4A:
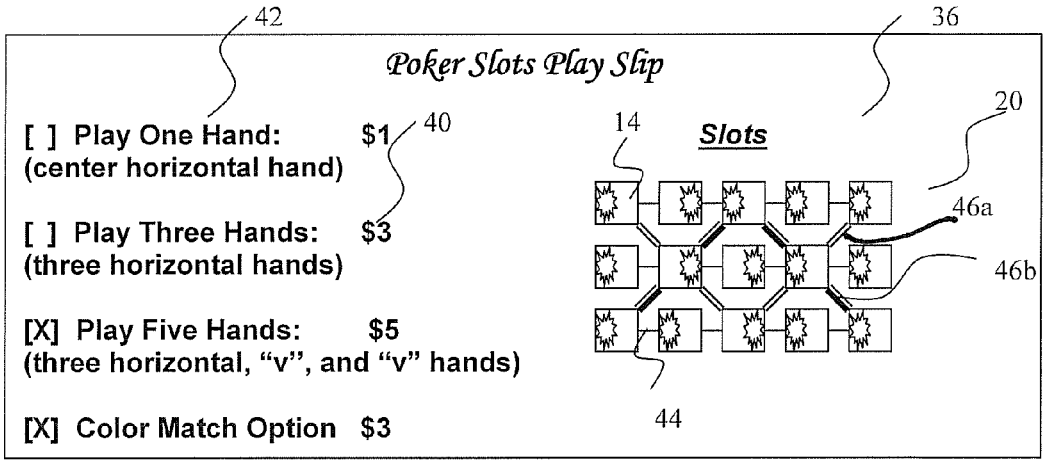
FIGS. 4A and 4B are perspective views of a play slip and associated lottery ticket for yet another embodiment in accordance with aspects of the invention.
Figure 4B:
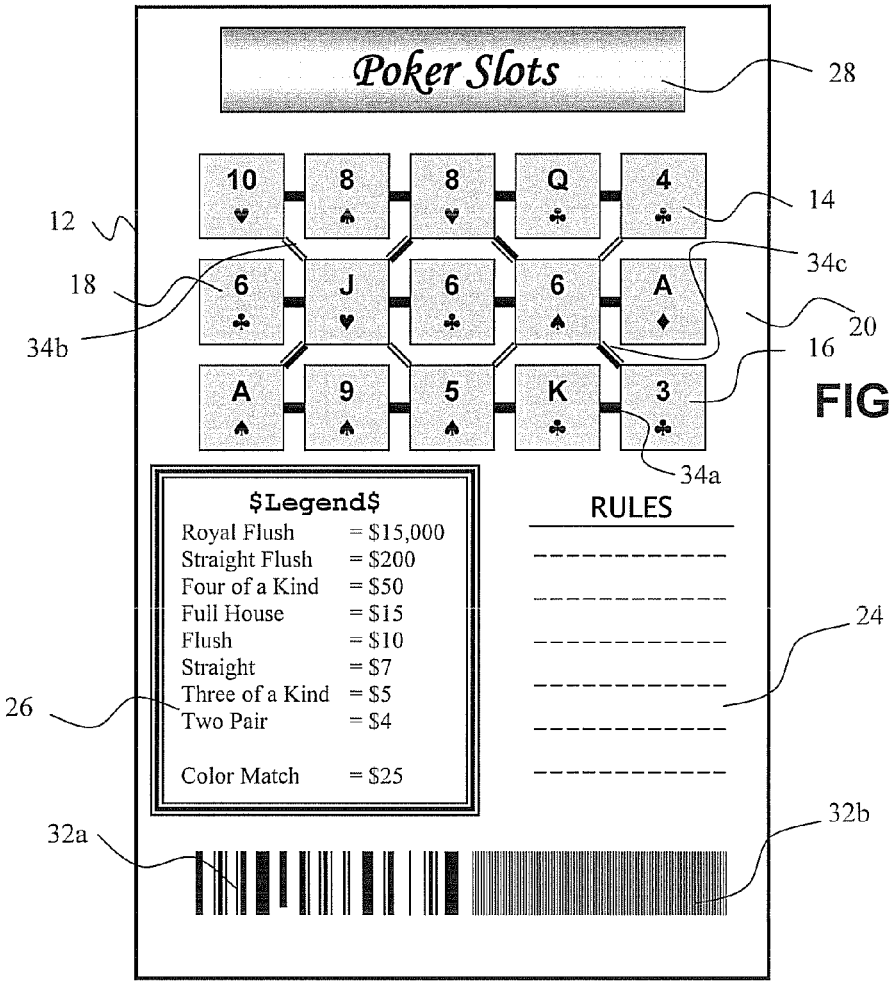

In the game illustrated by the play slip 36 in FIG. 4A and lottery ticket 12 in FIG. 4B, the player selected to play all of the possible hands by selecting the "play five hands" option in the selection area 42. This selection requires a wager of $5.00. The player placed a mark in all of the slot positions 14 indicated on the play slip. As discussed above, the horizontal connecting lines 44 define the horizontal poker hands. The connecting lines 46*a* define "V" hand, and the distinguishingly different connecting lines 46*b* define the "Λ" hand.

The play slip 36 in FIG. 4*a* also indicates a "color match" option selected by the player for an additional wager amount. In the illustrated embodiment, the wager amount is $3.00. In alternate embodiments, the wager amount for the color option may be the same as the base wager amount. For example, if the player plays a $1.00 base game, then the add-on amount for the color option would be $1.00. This color match option provides a means for the player to bet on receiving a poker hand containing cards of the same color, regardless of whether the cards are of the same suit. In other words, by paying for this option, the player is entitled to a prize award if all of the cards in any one of his selected hands are all red or all black. Referring to the ticket generated in FIG. 4B, the bottom horizontal hand does not have a winning poker hand, but contains cards that are all black. Thus, the player is entitled to the prize award for the color match option indicated in the legend 26. The middle horizontal hand is also a winning poker hand containing three of a kind, and the player is also entitled to a prize award for this hand.

Still referring to FIG. 4B, the player's selection of all five of the possible hands is indicated by all of the slot positions 14 being highlighted, as well as the horizontal connecting lines 34*a*, connecting line configuration 34*b* for the "V" hand, and the different line configuration 34*c* for the "Λ" hand. Again, any visually distinguishing means may be utilized to clearly indicate the player's selected hands.

Figure 5A:
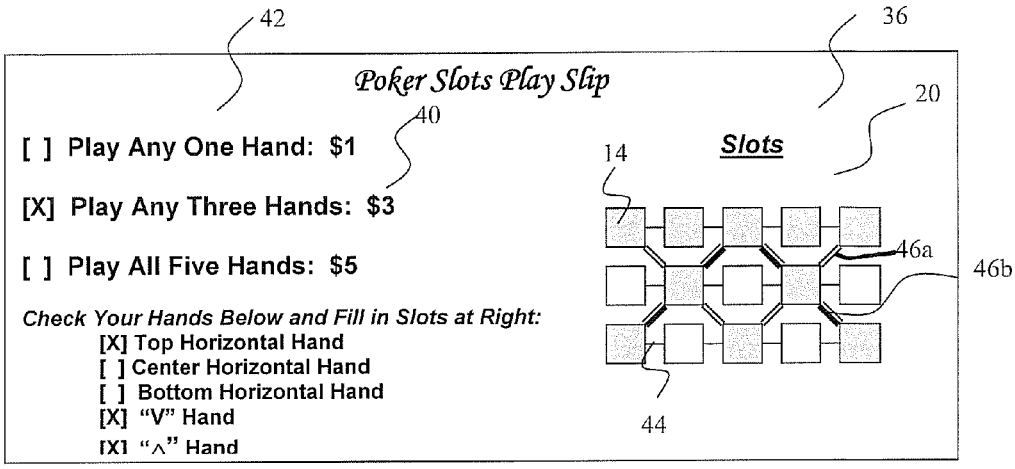
FIGS. 5A and 5B are perspective views of a play slip and associated lottery ticket for yet another embodiment in accordance with aspects of the invention.
Figure 5B:
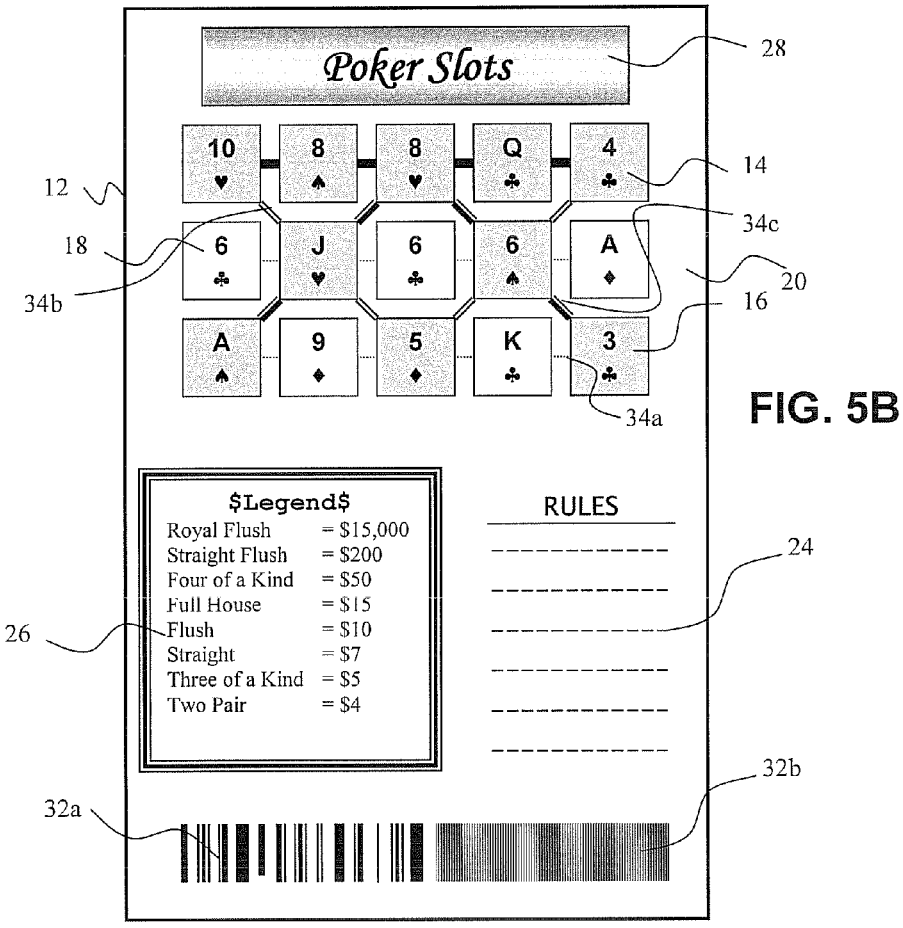

FIGS. 5A and 5B represent a game embodiment wherein the player may select any combination of the five hands. In other words, the player is not limited to one or three horizontal hands, or all five hands, as in the previous embodiments. In this embodiment, the player may play one hand, three hands, or all five hands, and then has the option to select the different hands. For example, in the play slip 36 illustrated in FIG. 5A, the player has selected to play three hands corresponding to the top horizontal hand, the "V" hand, and the "Λ" hand. The player's selection is also indicated by shading in the slot positions 14 on the play slip 36. The player's selection is also indicated on the lottery ticket 12 generated from the play slip 36, as indicated in FIG. 5B. The solid distinguishing connecting lines 34*a* clearly indicates that the player selected the top horizontal line, and the distinguishing line patterns 34*b*, 34*c* indicate that the player also selected the "V" and "Λ" hands. The slot positions 14 corresponding to these hands may also be highlighted.

Figure 6A:
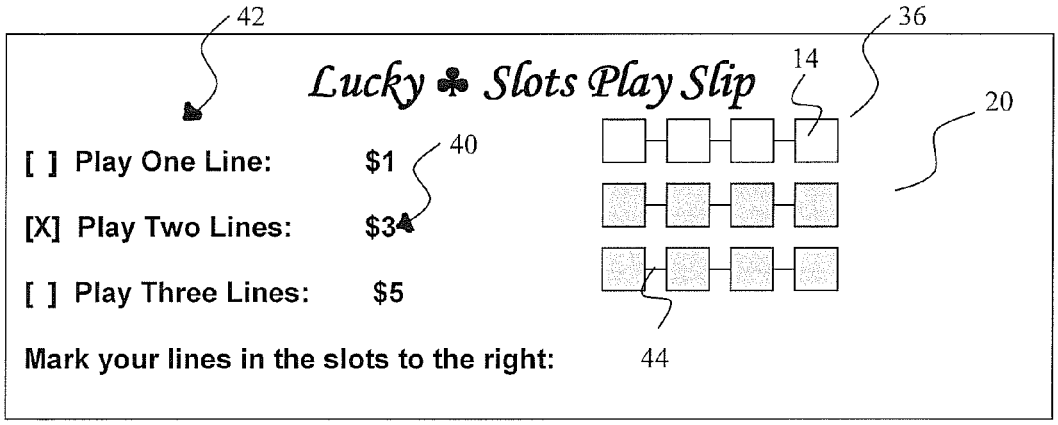
FIGS. 6A and 6B are perspective views of a play slip and associated lottery ticket for still another embodiment of a lottery game in accordance with aspects of the invention.
Figure 6B:
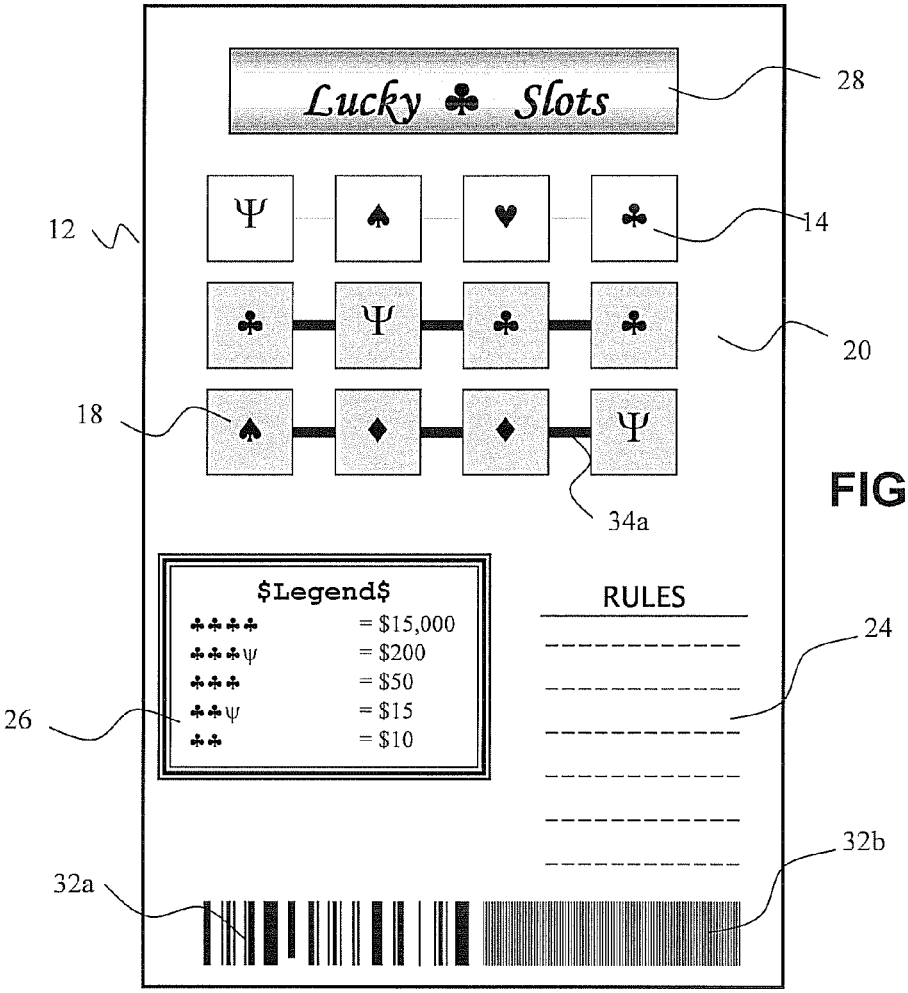

FIGS. 6A and 6B illustrate an alternative embodiment of a slot machine game theme other than a poker theme. In this particular embodiment, the purpose of the game is to achieve at least two clubs in a grouping or hand of four slot positions, as indicated by the legend 26 in the ticket 12 of FIG. 6B. According to the play slip 36 of FIG. 6A, the player selected to play two lines for a wager amount of $3.00. The player indicated the particular lines to be played by shading in the respective slot positions 14 representing the possible groupings 38. Note that in this particular game, only three groupings 38 are possible, with each grouping corresponding to a horizontal row of slot positions 14, as indicated by the connecting lines 44 in the play slip 36. In the ticket 12 illustrated in FIG. 6B, the player's selected groupings 20 are indicated by the shaded slot positions 14, as well as the distinct connecting lines 34*a*. The middle hand contains three clubs, and thus the player has won $50.00 as indicated in the prize legend 26.

Figure 7:
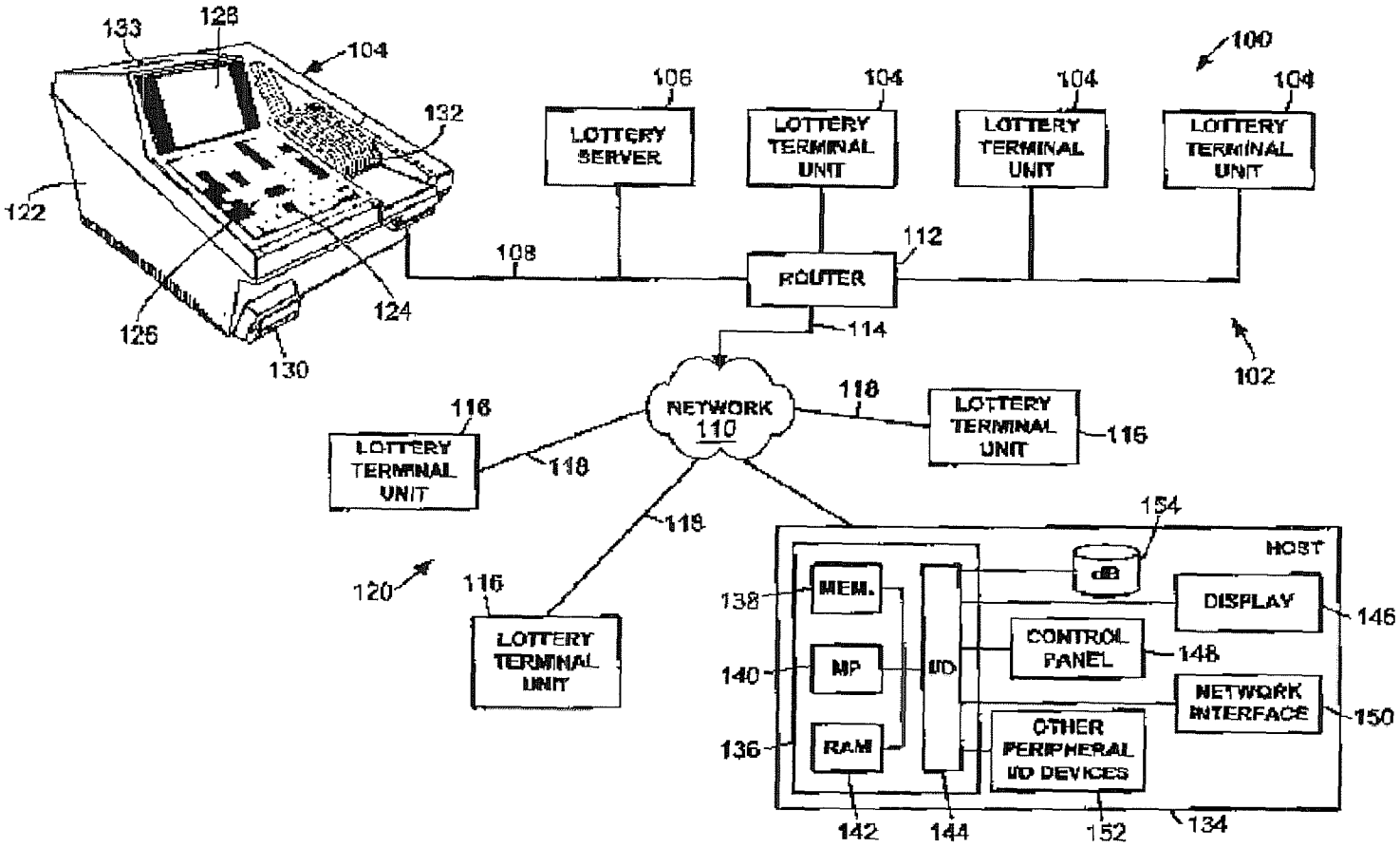
FIG. 7 is a block diagram of an embodiment of a networked lottery system that may be used for practice of the game methodology.
Figure 8:
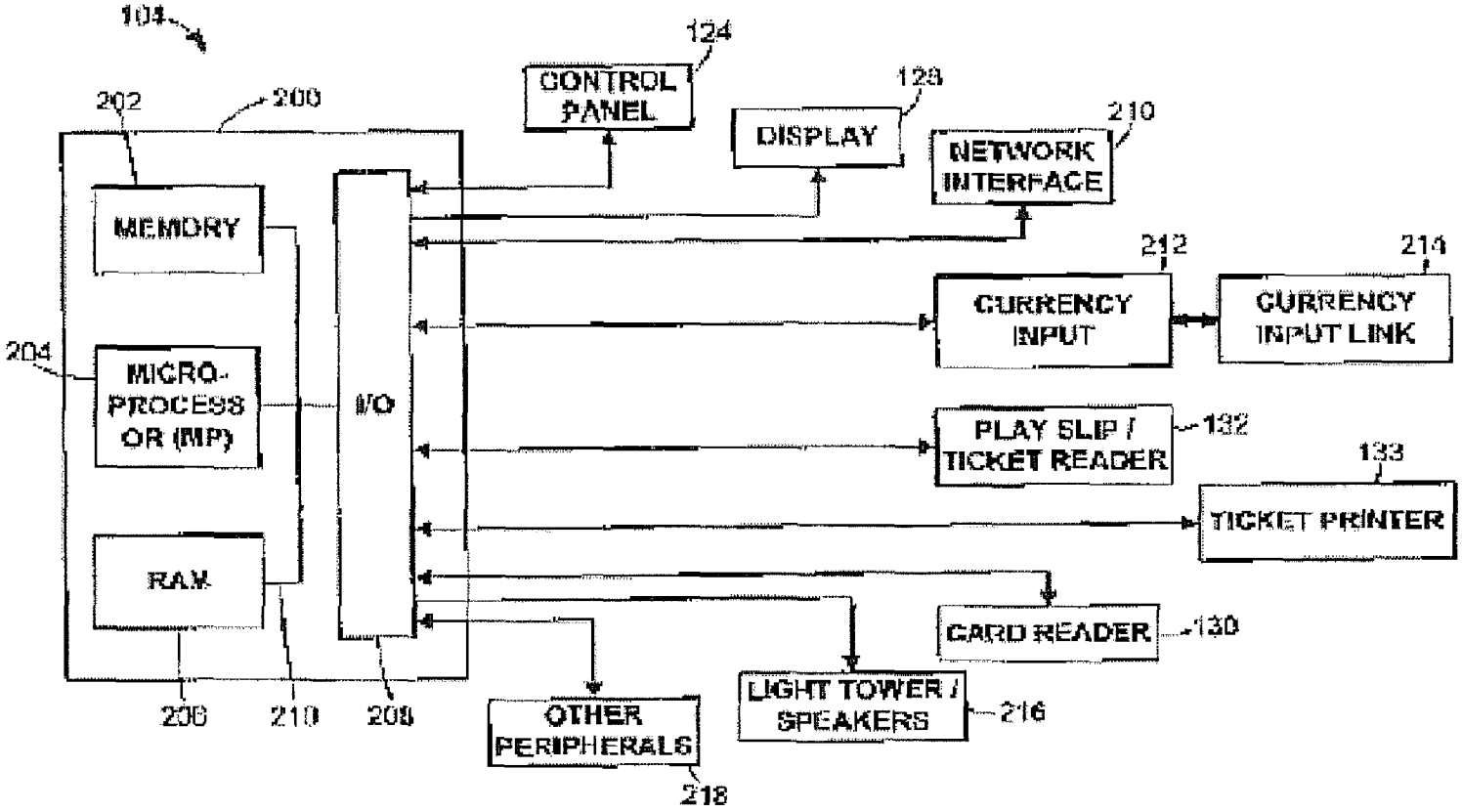
FIG. 8 is a block diagram of the electronic components of the lottery terminals shown in FIG. 7.

As discussed, the lottery game is particularly suited for online play at a plurality of lottery terminals that are in communication with a central game controller. The present invention encompasses any system configuration of hardware and software for implementing the lottery game for multiple players via remote gaming terminals in communication with the central computer. An exemplary configuration is illustrated in FIGS. 7 and 8 (discussed in greater detail below). Each of the lottery terminals includes an input device configured to receive the player's selection of at least one grouping of simulated slot positions. This device may be, for example, a play slip scanner, touch screen, keypad, or similar device. A value input device is configured to receive the player's wager for playing one or more groupings of the slot positions. The respective terminals include a controller having a processor and a memory operatively coupled to the processor. The controller operates with the input device, the value input device, and the central computer to receive and record the player's selected grouping of slot positions from a plurality of possible groupings, to assign a defined set of objects to each of the respective slot positions to simulate a slot machine reel associated with each slot position, and for randomly generating an object from the set of assigned objects for each of the slot positions such that a play set of the objects is generated for the player's selected grouping of slot positions. The lottery terminal provides the results of the game to the player via a lottery ticket, and computes a prize amount that is a function of the number or combination of matches of objects within the player's selected groupings.

The respective terminal controllers, alone or operating with the central computer, can generate a play set of objects for all of the possible groupings and present the play sets to the player via the lottery ticket printed at the terminal so that the player is aware of the prize value for any grouping not selected for play by the player. The terminal controller is configured to accept wagers from the player for up to all of the possible groupings, and to compute a prize amount for each winning grouping. By displaying the randomly generated play set of objects for all of the possible groupings, including the groupings not wagered on by the player, the player is made aware of prizes that may have been won.

In a particular embodiment, the central game controller defines the set and order of objects assigned to the respective slot positions so that the objects are the same for all of the game terminals. The central controller does not change the defined set and order of the objects between games. In other words, players are assured that the assigned set of objects (i.e. reel) for each slot position is the same regardless of which terminal is used to play the game. In an alternative embodiment, the central game controller may define the set or order of objects assigned to the respective slot positions differently for different game terminals.

FIG. 7 illustrates one possible embodiment of a lottery network 100 that may implement a device and method for implementing the slot machine online lottery game described herein. Referring to FIG. 7, the lottery network 100 may include a first group or network 102 of lottery terminal units 104 operatively coupled to a central lottery network computer or server 106 via a network data link or bus 108. The lottery network 100 may be coupled to a network 110, which may be, for example, the Internet, a wide area network (WAN), or a local area network (LAN) through a network hub or router 112 via a first network link 114. In one possible configuration, the first network 102 may be a state lottery system operating within an individual state or region of states. In this configuration, the individual lottery terminal units 104 may be interconnected to a central system for tracking and coordination of the lottery game over a wide geographic region. The central system may be implemented by the gaming authority, such as a state lottery system commission.

The lottery network 100 may further include other lottery terminal units 116 that may be directly connected to the network 110 through a plurality of direct network links 118, thereby eliminating the need for the bus 108, router 112 or other networking equipment. Each lottery terminal unit 116 in this configuration may represent a group of lottery retailers participating in the state lottery, or a plurality of the lottery terminal units 116 may be grouped together to form a lottery node 120. The lottery nodes 120, in turn, may be directly connected and/or multiplexed to the network 110 via the direct network links 118. Further, the direct network links 118 may represent secure communications channels physically hardened against tampering and/or the communications may be encrypted to prevent unauthorized access to information transmitted thereon.

FIG. 7 also illustrates a perspective view of one possible embodiment of a lottery terminal unit 104. Although the following description relates to the design of the lottery terminal unit 104 depicted in FIG. 7, it should be understood that the lottery terminal units 104 and 116 may include similar features or may be configured with functionality to allow a user to enter the information required to participate in a lottery game. The exemplary lottery terminal unit 104 may include a housing or casing 122, and one or more input devices, which may be, among other things, a control panel 124 having a plurality of input keys 126, a display 128, a value input device such as a card reader 130, a lottery play slip or ticket reader 132, and a lottery play ticket printer 133. The lottery play slip reader 132 may be configured to read bar codes, user selections, magnetically stored information or any other desired input information. The input keys 126 may allow the player or sales person to select the game to be played, input the value to be wagered, manually enter the selected lottery characters, and input any other information necessary to play a given lottery game. The display 128 may be a LCD, a CRT, a touch-screen capable of receiving and displaying information, or any other suitable device capable of displaying the information input via the input keys 126, the lottery play slip reader 132 or the touch-screen input. The value input device may include any device that can accept value or a wager from a customer, such as the card reader 130 or an optical currency collector. The value input device may further be integrated with external devices, such as cash registers or other retail terminals, communicatively connected to the lottery terminal unit 104, to exchange information necessary to receive and record the wagering transactions. The lottery ticket printer 133 may be used to print or otherwise encode lottery tickets with information selected or required to play a given lottery game. Further, the lottery printer 133 may provide lottery tickets, or even completed lottery slips if the selections were generated automatically, that could be used by the player in other lottery terminal units 116 equipped with lottery play slip or ticker readers 132.

The network 110, and hence the individual lottery terminal units 104, 116, may be communicatively connected to a central host 134. The central host 134 may be a single networked computer, or a series of interconnected computers having access to the network 110 via a gateway or other known networking system. Generally, the central host 134 may include a central lottery computer 136 configured to manage, execute and control the individual lottery elements 104, 116 and 120 and the routines used to play the various lottery games. The central lottery computer 136 may include a memory 138 for storing lottery programs and routines, a microprocessor 140 (MP) for executing the stored programs, a random access memory 142 (RAM) and an input/output bus 144 (I/O). The memory 138, microprocessor 140, RAM 142 and the I/O bus 144 may be multiplexed together via a common bus, as shown, or may each be directly connected via dedicated communications lines, depending on the needs of the lottery system.

Further, the central lottery computer 136 may be directly connected or hardwired or indirectly connected through the I/O bus 144 to external components such as a display 146, a control panel 148, a network interface device 150 and other peripherals I/O devices 152. Examples of other peripherals device include, but are not limited to, storage devices, wireless adaptors, printers etc. In addition, a database 154 may be communicatively connected to the central lottery computer 136 and provide a data repository for the storage and correlation of information gathered from the individual lottery terminal units 104, 116 or lottery nodes 120. The information stored within the database 154 may be information relating to individual lottery terminal units 104, 116 such as terminal specific information like the machine ID, sales agent, and location the location of each lottery ticket printed. The database 154 may further include ticket specific information, such as the assigned sets of objects for each slot position in the slot machine theme game for individual terminals or all of the terminals, or game specific information such as the total lottery sales; the drawing outcomes, amounts wagered, and so on.

In operation, the central lottery computer 136 may operate as a clearing-house for the lottery terminal units 116 and the first lottery network 102, whereby the lottery network computer 106 collects, stores and analyzes status and operational information relating to each lottery terminal unit 104. For example, the lottery network computer 106 may continuously receive transactional data from the individual lottery terminal unit 104 indicative of the number of tickets sold and associated dollar amounts, and the lottery numbers and number order generated at each lottery terminal unit. The transactional data collected by the lottery network computer 106 may be communicated to the central host 134 continuously or may be processed into a batch format and transmitted periodically for storage in the database 154. If, for example, the central lottery computer 136 and the lottery network computer 106 are communicating continuously, it may be desirable for the central lottery computer 136 to execute the actual lottery routine and transmit the results to the lottery network computer 106 for distribution to the lottery terminal units 104 and directly to the lottery terminal units 116. In addition, it may be desirable for the central lottery computer 136 to include, via the peripheral device input 152, a scanner, such as the lottery play slip reader 132, for directly importing/reading manual selections into the database 154.

It will be understood that the lottery network 100 illustrated in FIG. 7 may alternatively represent the network layout of a gaming establishment providing a lottery-type game. In this alternate configuration, each stand-alone lottery terminal unit 104 may be an interactive player terminal capable of playing a variety of casino games such as a lottery game, keno, bingo, video poker or slots. The lottery terminal units 104 may be distributed throughout a single gaming establishment or casino and connected with a LAN, or throughout multiple casino sites and connected with a WAN. Further, the LAN and/or WAN connecting each of the lottery terminal units 104 may include one or more separate and secure buses 108, routers 112, webservers, gateways and other networking equipment to insure continuous and/or redundant connectivity to the network 110. The network 110, configured in this manner, provides a system for players to collectively participate in a centralized lottery-type game. Further, the network 110 may include express lottery stations at which players may generate predefined or automatically selected lottery tickets simply by making a selection and a wager. As discussed above, the network 110 may be communicatively connected to the central host 134, the central lottery computer 136, and the database 142 to allow for implementation, storage, tracking and analysis of the lottery game.

FIG. 8 illustrates a block diagram of an embodiment of the internal components of a representative lottery terminal unit 104. The lottery terminal unit 116 may have the same or a different design. Referring to FIG. 8, the exemplary lottery terminal unit 104 may include a number of internal components such as a controller 200 having a program memory 202, a microcontroller or microprocessor (MP) 204, a random access memory (RAM) 206, and an input/output (I/O) bus 208, all of which may be interconnected via an address or data bus 210. It should be understood that although only one microprocessor 204 is shown herein, the controller 200 may be designed to support multiple microprocessors 204 arranged to operate in parallel or in any other known configuration. Similarly, the controller 200 may include multiple, and even redundant, program memory 202 and random access memory 206 to increase expandability, capacity and/or processing speed. The multiple processor and memory configuration, may be used, for example to isolate the individual lottery functions such as basic lottery operation, random number generation, information tracking etc. Although the I/O bus 208 is shown as a single addressable and integral block, it should be understood that direct I/O connections may be made, as well as any other desired I/O connection scheme. The program memory 202 and random access memory 206 may be implemented as a solid-state memory, an integrated circuit, a magnetically readable memory, and/or optically readable memories. Further, the program memory 202 may be read only memory (ROM) or may be read/write memory such as a hard disk. In the event that a hard disk is used as the program memory, the data bus 210 may comprise multiple address/data buses, which may be of differing types, and there may be a separate I/O circuit between the data buses.

FIG. 8 schematically illustrates that the controller 200 may be communicatively connected to the control panel 124, the display 128, the card reader 130, the lottery play slip or ticket reader 132 and the ticket printer 133. The controller 200 may further be communicatively connected to a network interface card (NIC) or device 210, a currency input device 212 including a currency input link 214, and a light and speaker link 216. The network interface card 210 may be configured to allow the lottery terminal unit 104 to communicate information with other networked devices, similarly connected to the network 110, using any known protocol or standard suitable for a lottery or network application. The currency input device 212 may be any kind of value input device discussed above, or may include a currency input link 214 communicatively connected to a cash register (not shown) or other device for tracking and/or totaling currency or transactions. The light and speaker link 214 may be used to integrate visual and/or audio displays into the design of the lottery terminal unit 104.

FIG. 8 illustrates the components 124, 128-132, and 210-218 directly connected to the I/O bus 208 via dedicated circuits or conductors, however it will be understood that different connections schemes may be used. For example, some of the components requiring limited communications with the controller 200 may be communicated via an auxiliary I/O bus (not shown) in a scheduled manner, while other components requiring fast communications or large data transfers may be directly connected to the I/O bus 208. Furthermore, depending on the needs of the system, some of the components may be directly connected to the microprocessor 184 without having to pass through the I/O bus 208.

It should be readily appreciated by those skilled in the art that various modifications and variations can be made to the embodiments of the method and systems described herein. It is intended that the present invention encompass such modifications and variations as come within the scope of the appended claims and their equivalents.

What is claimed is:

1. A method for playing a lottery game having a poker slot machine theme, comprising:

assigning a set of poker playing cards to each of a respective plurality of slot positions such that each of the sets is unique to a respective slot position and an entire deck of poker playing cards is accounted for by the sets, the cards assigned to the respective slot positions being unknown to game players;

requesting a player to choose at least one poker hand of slot positions from a plurality of possible hands, and recording the player's selection;

for each of the slot positions, randomly selecting a card from the set of poker playing cards assigned to the respective slot position such that a poker hand is generated for the player's selection of slot positions; and awarding to the player a prize amount that is a function of the player's poker hand such that a stronger poker hand wins a greater prize amount.

2. The lottery game method as in claim 1, wherein a wager amount is collected from the player prior to play, the wager amount being a function of the number of hands selected for play by the player.

3. The lottery game method as in claim 2, wherein a poker hand is generated for all of the possible hands and presented to the player so that the player is aware of the value of any poker hands not selected for play by the player.

4. The lottery game method as in claim 3, wherein the player has the option to wager on up to all of the possible poker hands, and is awarded a prize amount for each winning poker hand.

5. The lottery game method as in claim 1, wherein the lottery game is played at a plurality of terminals in communication with a central game controller, with the set of poker playing cards assigned to respective slot positions being the same for all of the terminals and does not change between games.

6. The lottery game method as in claim 1, wherein the lottery game is played at a plurality of terminals in communication with a central game controller, with the set of poker playing cards assigned to respective slot positions varying between different game terminals.

7. The lottery game method as in claim 6, wherein the set of poker playing cards assigned to respective slot positions does not change for each respective terminal.

8. The lottery game method as in claim 5, wherein a player selects the slot positions corresponding to their poker hand via a play slip that is completed by the player and read at one of the lottery terminals, the terminal printing a ticket that reflects all of the randomly generated poker hands in the game and identifies the player's poker hand.

9. The lottery game method as in claim 1, further comprising a color match option wherein a player pays an additional wager for the possibility of winning if the cards in any one of their poker hands are all the same color regardless of whether the hand also is a flush.

10. A method for playing a lottery game having a slot machine theme, comprising:

assigning a defined set of objects to each of a respective plurality of slot positions such that each of the sets is unique to a respective slot position and a particular object is assigned to only one slot position, the objects assigned to the respective slot positions being unknown to game players;

requesting a player to choose at least one grouping of the slot positions from a plurality of possible groupings, and recording the player's selection;

for each of the slot positions, randomly selecting an object from the set of objects assigned to the respective slot position such that a play set of the objects is generated for the player's grouping of slot positions; and awarding to the player a prize amount that is a function of the number or combination of matches of objects within the player's play set.

11. The lottery game method as in claim 10, wherein a wager amount is collected from the player prior to play, the wager amount being a function of the number of groupings of slot positions selected for play by the player.

12. The lottery game method as in claim 11, wherein a play set is generated for all of the possible groupings and presented to the player so that the player is aware of the value of the prize value for any grouping not selected for play by the player.

13. The lottery game method as in claim 12, wherein the player has the option to wager on up to all of the possible groupings, and is eligible for a prize amount for each winning grouping.

14. The lottery game method as in claim 10, wherein the lottery game is played at a plurality of terminals in communication with a central game controller, wherein the set of objects assigned to respective slot positions is the same for all of the terminals and does not change between games.

15. The lottery game method as in claim 10, wherein the lottery game is played at a plurality of terminals in communication with a central game controller, wherein the set of objects assigned to respective slot positions varies between different game terminals.

16. The lottery game method as in claim 15, wherein the set of objects assigned to respective slot positions does not change for each respective terminal.

17. The lottery game method as in claim 15, wherein a player selects the slot positions corresponding to their grouping via a play slip that is completed by the player and read at one of the lottery terminals, the terminal printing a ticket that reflects all of the randomly generated groupings in the game and identifies the player's grouping.

18. The lottery game method as in claim 10, further comprising a color match option wherein a player pays an additional wager for the possibility of winning if the objects in any one of their groupings are all the same color regardless of the number or combination of object matches.

19. A system for conducting an online terminal based lottery game having a slot machine theme, said system comprising, a central computer having a hardware and software configuration to conduct the lottery game for multiple players via remote gaming terminals;

a plurality of said remote gaming terminals in communication with said central computer, each of said terminals further comprising;

an input device configured to receive a player's selection of at least one grouping of simulated slot positions from a plurality of presented groupings of the slot positions;

a value input device configured to receive the player's wager for playing one or more groupings of the slot positions;

a controller with a processor and memory operatively coupled to said processor, said controller operative with said input device, said value input device, and said central computer to:

receive and record the player's selected grouping of slot positions;

assign a defined set of objects to each of the respective slot positions such that each of the sets is unique to a respective slot position and a particular object is assigned to only one slot position, the objects assigned to the respective slot positions being unknown to game players;

for each of the slot positions, randomly select an object from the set of objects assigned to the respective slot position such that a play set of the objects is generated for the player's selected grouping of slot positions and provided to the player via a lottery ticket; and compute a prize amount that is a function of the number or combination of matches of objects within the player's selected grouping.

20. The lottery game system as in claim 19, wherein said input device comprises a play slip reader configured to import the player's selected grouping of slot positions coded onto a play slip by the player.

21. The lottery game system as in claim 19, wherein said input device comprises a touch-screen device configured for inputting the player's selected grouping of slot positions via manual entry.

22. The lottery game system as in claim 19, wherein said controller generates a play set of objects for all of the possible groupings and presents the play sets to the player via the lottery ticket so that the player is aware of the prize value for any grouping not selected for play by the player.

23. The lottery game system as in claim 19, wherein said controller is configured to accept wagers from the player for up to all of the possible groupings, and to compute a prize amount for each winning grouping.

24. The lottery game system as in claim 19, wherein said central game controller defines the set of objects assigned to respective slot positions the same for all of the terminals and does not change the defined sets of objects between games.

25. The lottery game system as in claim 19, wherein said central game controller defines the set of objects assigned to respective slot positions differently for different game terminals.

26. The lottery game system as in claim 25, wherein said central game controller varies the set of objects assigned to respective slot positions between games played at the respective game terminals.

* * * * *